US006027820A

United States Patent [19]

O'Hagan et al.

[11] Patent Number: 6,027,820

[45] Date of Patent: Feb. 22, 2000

[54] CONTINUOUS WEB REGISTRATION

[75] Inventors: Brian O'Hagan, Lawrence, Kans.; James M. Birt, Akron; Steven Patterson, Streetsboro, both of Ohio

[73] Assignee: JPS Packaging Co., Prairie Village, Kans.

[21] Appl. No.: 08/821,065

[22] Filed: Jul. 28, 1997

Related U.S. Application Data

[63] Continuation-in-part of application No. 08/585,122, Jan. 11, 1996, abandoned.

[51] Int. Cl.[7] ..... B32B 9/04

[52] U.S. Cl. ..... 428/543; 428/195; 428/500; 428/913; 283/92

[58] Field of Search ..... 283/92; 428/195, 428/500, 211, 411.1, 913, 29, 543; 250/459.1

[56] References Cited

U.S. PATENT DOCUMENTS

| | | | |
|---|---|---|---|
| Re. 28,732 | 3/1976 | Von Hofe | 156/64 |
| 2,629,956 | 3/1953 | Switzer | 41/26 |
| 2,983,686 | 5/1961 | Konig | 252/301.2 |
| 3,115,417 | 12/1963 | Christensen | 117/33.5 |
| 3,177,153 | 4/1965 | Pommer et al. | 252/301.2 |
| 3,671,451 | 6/1972 | Butterfield | 252/301.2 |
| 3,776,761 | 12/1973 | Kato et al. | 117/76 P |
| 3,869,983 | 3/1975 | Garber et al. | 101/137 |
| 3,892,972 | 7/1975 | Cevasco | 250/458 |
| 3,922,435 | 11/1975 | Asnes | 428/349 |
| 4,009,551 | 3/1977 | Greenawalt et al. | 53/28 |
| 4,068,028 | 1/1978 | Samonides | 428/40 |
| 4,381,211 | 4/1983 | Nechay | 156/361 |
| 4,383,880 | 5/1983 | Geurtsen et al. | 156/361 |
| 4,392,056 | 7/1983 | Weyandt | 250/339 |
| 4,445,775 | 5/1984 | Tongel | 355/122 |
| 4,452,659 | 6/1984 | Geurtsen et al. | 156/361 |
| 4,467,207 | 8/1984 | Lerner et al. | 250/459.1 |
| 4,534,288 | 8/1985 | Brovman | 101/211 |
| 4,648,907 | 3/1987 | Hays et al. | 106/30 |
| 4,680,205 | 7/1987 | Lerner et al. | 428/29 |
| 4,925,705 | 5/1990 | Hill | 427/259 |
| 4,945,252 | 7/1990 | Lerner et al. | 250/548 |
| 4,963,459 | 10/1990 | Beery et al. | 430/138 |
| 4,999,076 | 3/1991 | Incremona et al. | 156/241 |
| 5,021,090 | 6/1991 | Schwartz et al. | 106/23 |
| 5,062,894 | 11/1991 | Schwartz et al. | 106/23 |
| 5,135,569 | 8/1992 | Mathias | 106/22 |
| 5,167,558 | 12/1992 | Duchek et al. | 445/64 |
| 5,229,353 | 7/1993 | Vanmaele et al. | 503/227 |
| 5,235,515 | 8/1993 | Ungpiyakul et al. | 364/469 |
| 5,272,980 | 12/1993 | Takeuchi et al. | 101/481 |
| 5,360,235 | 11/1994 | Drummeter et al. | 283/89 |
| 5,360,628 | 11/1994 | Butland | 427/7 |
| 5,401,960 | 3/1995 | Fisun et al. | 250/271 |
| 5,402,726 | 4/1995 | Levien | 101/481 |
| 5,421,869 | 6/1995 | Gundjian et al. | 106/21 |
| 5,421,933 | 6/1995 | Nedblake et al. | 156/249 |
| 5,458,715 | 10/1995 | Takeuchi et al. | 156/241 |
| 5,464,289 | 11/1995 | Beaudry | 400/62 |

*Primary Examiner*—William Krynski
*Assistant Examiner*—Hong J. Xu
*Attorney, Agent, or Firm*—Oldham & Oldham Co.,L.P.A.

[57] ABSTRACT

The invention describes a web having a plurality of discrete labels thereupon which includes a pair of plies in face-to-face relationship with one another, a visible coating on at least one surface of at least one of the plies, the coating being in the form of a repetitive pattern to provide a series of separable web sections, each of the sections being adapted for separation from the web to provide a commodity of substantially identical commodities formed by separation from the web, at least one visible eyemark on the web, and at least one ultraviolet fluorescing eyemark on the web. The eyemarks can completely overlap, partially overlap, or be discrete entities depending upon the end application. The ultraviolet fluorescing eyemark can be a non-visible fluorescing pigment or a naturally fluorescing visible pigment. When all printing decks of a printing station are in use, it is possible to add the fluorescing pigment to an existing color deck of the printing station, thereby eliminating the need for a separate ultraviolet printing deck.

19 Claims, 2 Drawing Sheets

CONTINUOUS WEB REGISTRATION

This application is a continuation-in-part of Ser. No. 08/585,122 filed Jan. 11, 1996, now abandoned.

TECHNICAL FIELD

The invention described herein pertains generally to the use of ultraviolet fluorescing marks in registration alignment processes in high speed roll label applications.

BACKGROUND OF THE INVENTION

Continuous plastic webs are manufactured for many purposes, e.g., flat sheets of discrete bottle labels, wherein each label is ultimately applied around a blow-molded plastic, or similar bottle. In the manufacture of webs of labels, it is important that manufacturing operations be accurately located along the web. Accordingly, it is important to accurately register the web with work stations on the machine performing operations on the web.

While there is reasonable latitude or tolerance in the location of any given operation on a web, there is a cumulative error problem which must be considered. When transferring printed indicia onto a web of labels, cumulative error cannot be tolerated in that over the passage of hundreds to thousands of feet of printed labels, if registration is not corrected, the printed indica will not be centered on the product onto which it is affixed. The cumulative error problem is exacerbated when the web is plastic in that plastics tend to stretch. Since it is virtually impossible to maintain constant web tension during printing and other manufacturing operations, stretching not only occurs, but it occurs unevenly.

Because of the cumulative error problem, it is customary to repeatedly register the web with stations where manufacturing operations are to be performed. One known technique is to provide clear spaces in a web between the repetitive printed indicia. These spaces function as windows into which a registration mark is imprinted. An optical detector is positioned to cyclically view the web. If the equipment is adjusted and functioning properly, each viewing of a cycle is concurrent with the passage of one of the windows past the detector. The detector senses the registration mark and causes the manufacturing operation to occur at a time coordinated with this sensing.

When printed decorative and informative indicia on the web are passing the detector, the detector is often "blinded" so that it will not see and be confused by the imprinted indicia. One solution to this problem is to cycle the detector in synchronism with the passage of decorative and informative indicia pass. A major problem with cyclical detection however is that if the web is out of registration when the detector is operative, the window of informative indicia may not be seen, and erroneous signals will be emitted by the detector, resulting in scrap. Thus, machine setup, and the restoration of appropriate registration of the machine which gets out of synchronism, is time-consuming and difficult.

The effectiveness of traditional registration marks for controlling operations even on essentially a clear web, a web which is not printed except for the visible "eye" marks, is also limited with respect to accuracy of detection. The accurate detection of such registration marks is dependent on either, the largeness of the mark or, in the case of a small mark, the accuracy with which the detector is registered upon the fluctuating paths in which the marks travel. The accurate detection of traditional eye marks affixed to a plastic or other flexible, stretchable, elastic web requires either: a large eyemark to insure that passage of at least some portion of each mark underneath a stationary detector; or in the case of small eye marks, a sophisticated detector tracking apparatus to insure the consistent registration of the detector upon the fluctuating paths of the moving marks.

One effort to improve over the use of "visible eyemarks" is described in U.S. Pat. No. 4,467,207 to Lerner et al., which teaches the use of organic polar or ionic material that emits wavelength-shifted radiation under incident electromagnetic radiation. The choice of a "polar" dye was indicated to be critical to the operation of the Lerner et al., invention in that migration of "non-polar" dyes was an issue, but not of "polar" dyes.

Specifically, various "polar" or "ionic" dyes show below were taught to be effective in the application.

Chemical Formula

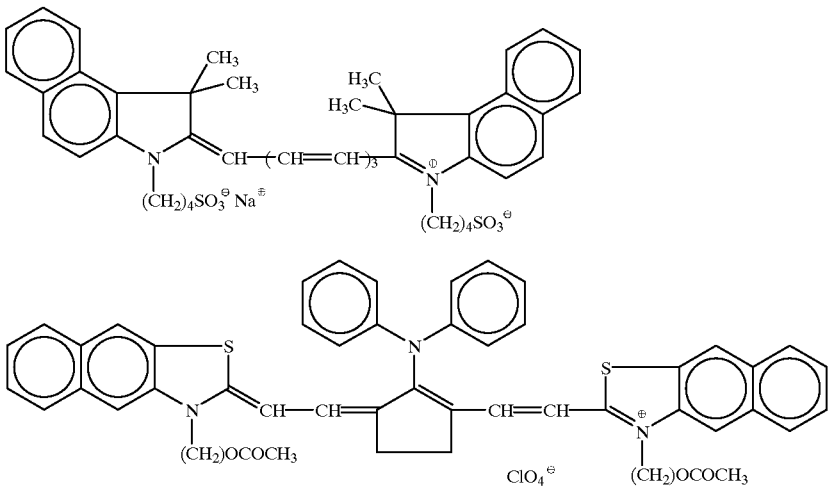

-continued

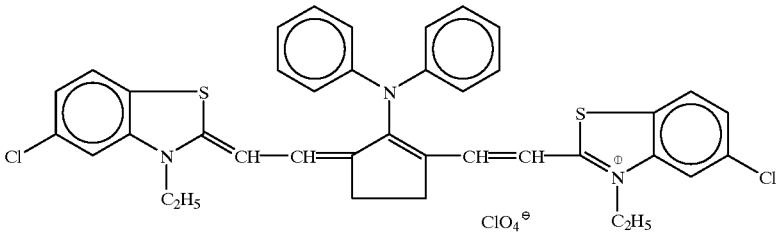

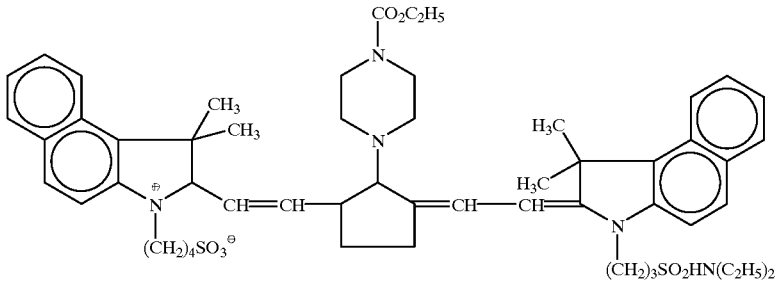

As taught by Lerner et al., the migration of a dye is controlled by its solubility. Lerner determined that by using a polar or ionic dye, there would be no migration through the non-polar polymer films, thereby capitalizing on a system of "like/unlike", i.e., "polar or ionic dye/non-polar polymer film."

Another approach to maintaining appropriate registration between a web and various work stations is to provide a marginal registration strip with printed or other registration markings. While such an approach can simplify machine set up and registration, as compared with the cyclically blinded detector approach, the strip is trimmed off and becomes scrap so this process is wasteful.

A variation in the technique for controlling the web movement with a removable strip employs gaps or holes positioned along the strip as position indicators for the web. The presence of the gap is detected by a spark-gap detector which completes a circuit by causing a spark to traverse the gap. In this way, the presence of absence of gaps or holes along the web is indicated to control circuitry which in turn is used for maneuvering the web.

The spark-gap system for web control also has deficiencies. In order to complete a circuit with the use of a spark, it is necessary that a relatively high voltage be maintained between two portions of the spark-gap detector. In some environments, this can be very undesirable. For example, moisture can either cause a malfunction of the spark-gap detector or provide a path of low electrical resistance which results in a false signal. A second problem encountered is that the detector cannot tell the difference between intentionally and unintentionally formed gaps or holes. If the control circuitry is activated by the presence of a rip in the registration strip of the web, control functions will be unsynchronized and web material will be wasted.

It has been suggested, that magnetization of an area directly on the web with a decorative coating printed over the magnetized area can be used to provide a non-visible control function to the moving web. Magnetized areas are susceptible to detection by various known techniques and have been proposed for providing control coordination. A magnetized area, however, can be affected by its environment in an adverse manner. Electric and magnetic fields in the area of the moving web could create a condition where the detector would not detect the magnetized area and control coordination would be lost. Further, if the magnetized area is placed directly on the web, it is virtually impossible to hide the magnetized area with a printing overlay and with clear webs, the area will be visible from the other side of the web. Thus, a magnetized area detracts from an intended and desired attractive appearance.

However, what is needed in the industry, is both a visible and ultraviolet registration technology for use in flat sheet label applications using existing equipment, optionally using one of the printing decks for ultraviolet ink application, or when this is not possible due to existing printing requirements on the label and the limitations of the physical number of printing decks on the machine, using a naturally ultraviolet fluorescing pigment in one of the printing decks, thereby serving to utilize one deck for both ultraviolet and visible marking. Alternately, an ultraviolet fluorescing system which did not migrate, yet which was a "like/like" combination, i.e., "non-polar or non-ionic pigment/non-polar polymer film" would be unexpected and opposed to the teachings of the Prior Art.

SUMMARY OF THE INVENTION

In accordance with the present invention, there is provided an ultraviolet printing and detection system which minimizes the problems experienced using visible color detection schemes for web registration. The present invention overcomes difficulties encountered with prior art web control techniques by treating the web to provide spaced control signal forming or locating portions with invisible components for signal emission as an integral part of the web. These control signal markings or patterns are applied to the web and waste is eliminated because the whole web can be utilized in the final product. Since the control signals preferred are non-visible to the human eye, the physical appearance of the web or product is in no way limited to the configuration or appearance of decorative and/or informative information applied to the web. The non-visible markings, which are preferably transparent, can be applied at any portion of the web without regard to the physical appearance of the design of the web.

The locating portions respond to energy of predetermined characteristics directed to the web in a manner different from the response of other portions. In a preferred embodiment of the invention, a web of material has a transparent pattern of material which emits wavelength shifted radiation in response to ultraviolet radiation. When the ultraviolet radiation is shining on the web, the wavelength shifting causes a shift in wavelength and it emits relatively high intensity electromagnetic radiation which is in a different spectrum range.

One advantage of electromagnetic wavelength shifting markings which are not visible to the human eye but produce wavelength shifted radiation in response to incident electromagnetic radiation is that it is possible to use a detector system which responds to the wavelength shifted radiation and not to ambient or reflected radiation. Thus, such a detector is not affected by reflections from the web or decorative and informative printing on the web so the entire surface of the web can be clear or printed and no timer strip or "window" is required.

A major reason the detector is unaffected by the reflection is that in a typical modern industrial environment, low intensity lighting is provided. Any given type of light used in an industrial environment provides radiation of relatively low intensities which are readily distinguishable from the high intensity emission of the indicia even when reflections and emissions are of the same or similar wavelengths. Electromagnetic wave shifting material used in the control markings or indicia of this invention are selected from those which emit electromagnetic energy in relatively high intensities in response to stimulation by relatively high intensity radiation. The wavelength shifted radiation is significantly different from reflected radiation in the sense that the intensity is sufficiently different to enable ready detection.

The pattern of wave shifting material can be either intermittent or continuous and is arranged to contain information which is used in controlling functions performed on the web. The information is used in conjunction with other control devices which are activated by signals from the web, each of which indicates a given control portion is at a predetermined location along a path of web travel.

A control station for detection of signals from the web includes a source of high intensity, indicia stimulating electromagnetic radiation which causes the web markings to emit wave shifted radiation and a detecting system which detects the wavelength shifted radiation and converts the electromagnetic radiation from that material into electrical signals. The detection system preferably includes a filtration system to exclude reflected electromagnetic radiation of wavelengths other than the wavelength band of the radiation emitted by the markings so that, among other things, reflections from the high intensity source are filtered out.

A preferred detection system is response to an essentially non-visible pattern in the form of markings which emit wavelength shifted electromagnetic radiation. This detection system includes a filter which transmits indicia emitted wave shifted radiation in a range of the spectrum to a detector, but transmits essentially no reflected radiation of certain other wavelength ranges.

One advantage of this system is the utilization of a pattern which can be applied directly to the web and which contains information useful in controlling web movements. Since the pattern of information normally is invisible to the eye, the information containing material can be used in conjunction with designs or logos of any size, shape and nature without disrupting their appearance.

The pattern of information contained within the wavelength shifting material may be continuous or intermittent. For some applications, a series of repetitive, spaced strips of wave shifting material will be adequate for producing control information. In other applications, it may be desirable to apply a continuous pattern of material to the web.

In one embodiment of this invention, the ultraviolet fluorescing compound is added to an existing color ink in the label design and printed as an eyespot which will respond both visibly and upon exposure to ultraviolet light. This solution will easily be integrated into existing print schemes in that only the addition of an ultraviolet fluorescing pigment to an existing color deck is needed.

For other applications, where perhaps, a color deck at the printing station is not in use, it is possible to print the ultraviolet fluorescing compound onto the label with the non-used printing deck station. This will dedicate one printing deck to the ultraviolet fluorescing compound.

In still other applications, where a color deck at the printing station is not available, it is possible to add the ultraviolet fluorescing compound onto the label through its incorporation into an existing color, which is printed in the label in a non-eyespot region of the label, but which can additionally be used for registration purposes.

It is an object of this invention to provide an ultraviolet processing aid which will overcome existing problems associated with visible eyespots in web registration. Utilization of an invisible control signal allows for a standardized design of information containing material regardless of the physical appearance of the web. Thus, the control signal design need not be changed when webs of differing physical appearance are substituted and since a standardized control can be used, the web control system need not be modified for every change of web design. Moreover, the application of an invisible web control to the web allows registration of the web during manufacture and during use with comparable systems using the same invisible control signal markings.

These and other objects of this invention will be evident when viewed in light of the drawings, detailed description, and appended claims.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof, and wherein.

DETAILED DESCRIPTION OF THE INVENTION

Figure 1:
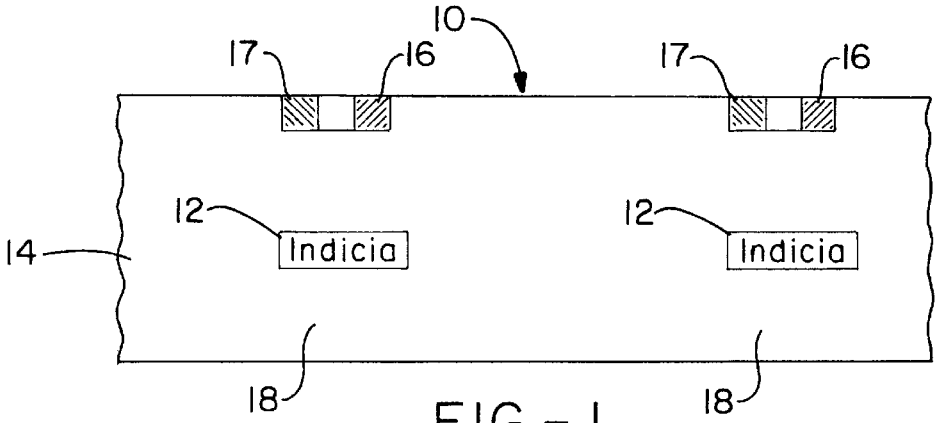
FIG. 1 is a top plan view of a portion of a web of labels containing print indicia showing an eyespot for registration purposes, the eyespot serving both as a visible and an ultraviolet indicator, the indicators overlapping.

Referring now to the drawings wherein the showings are for purposes of illustrating the preferred embodiment of the invention only and not for purposes of limiting the same, the Figures show a process schematic and several labels which are produced as a result of following the process. The best mode for carrying out the invention will now be described for the purposes of illustrating the best mode known to the applicant at the time. The examples are illustrative only and not meant to limit the invention, as measured by the scope and spirit of the claims.

Figure 2:
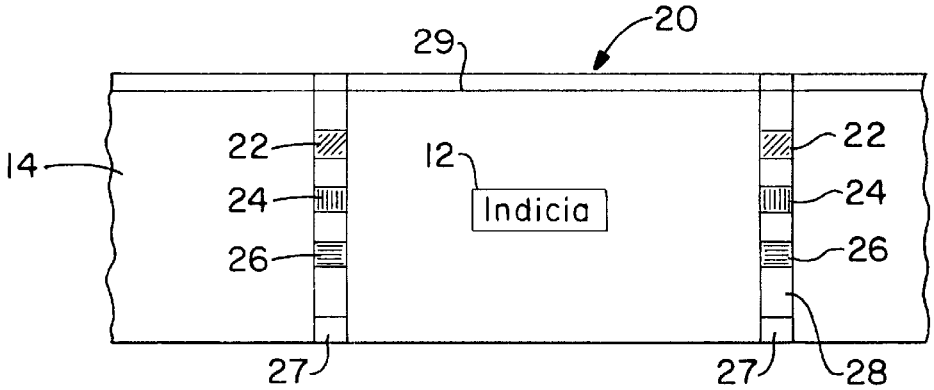
FIG. 2 is a view as in FIG. 1 showing an eyestrip for registration purposes, the eyestrip serving once again both as a visible and an ultraviolet indicator, the ultraviolet indicator being shown in two locations, one continuous line and a plurality of discrete ultraviolet eyespots.

FIG. 1 shows a portion of a label web (10) which contains a plurality of individual labels suitable for application onto a variety of substrates. Each label (18) on the web (10) typically contains print indicia (12), a visible eyespot (16) and an ultraviolet fluorescing eyespot (17). The labels are typically colored, although they may be transparent. The visible eyespot (16) is typically of a contrasting color to permit electronic detection thereof for web registration purposes. In one embodiment of this invention, the visible eyespot (17) not only contains a contrasting color (e.g., black) to that of the web (e.g., red), but additionally comprises an ultraviolet fluorescing eyespot (17). These eyespots may completely overlap, partially overlap (as shown in FIG. 1), or as in FIG. 2, be non-overlapping.

The ultraviolet fluorescing eyespot may comprise an ultraviolet fluorescing pigment, but may also include naturally fluorescing visible pigments. The benefit of having both the ultraviolet and visible eyespots coincide is that the application of the eyespot can be accomplished by using only one printing deck at a printing station. Printing stations have a plurality of printing decks. For many labels, all of the printing decks available are used in the printing of the label. Since many product manufacturers are not disposed to redesigning their distinctive label coloration schemes which have customer loyalty associated therewith, and since it is extremely expensive, if even possible, to add an additional printing deck, the easiest resolution is to add an ultraviolet fluorescing pigment to one of the existing visible printing decks in the printing station. It is of course recognized that when the visible eyespot and ultraviolet fluorescing eyespot do not coincide, that the application of the ultraviolet fluorescing eyespot will take up one separate printing deck on the printing station.

While prior art patents have taught the benefits of eliminating the visible color eyespot, it has been found that this is not always desirable. In setting up the web label printing operation, visible eyespots provide a quick setup means which aid the operator in configuring the system. Ultraviolet fluorescing detection is of primary importance only when high speed production lines are in full operation. Initial setup is still facilitated by visual means.

FIG. 2 once again shows a portion of a label web (20) also containing a plurality of individual labels. Each label (18) on the web (20) contains print indicia (12) and an eyestrip (28) of a contrasting color. The eyestrip may contain at least one, preferably two or more of color indicia (22, 24, 26) on the strip for registration purposes and at least one ultraviolet eyespot (27) or line or zone (29). In a manner similar to that described with FIG. 1, the visible eyestrip is typically of a contrasting color to permit electronic detection thereof. One or more eyespots (22, 24, 26) within an eyestrip (28) may in addition to containing a visible pigment, comprise an ultraviolet fluorescing pigment (27). For some applications, one or more eyespots within the eyestrip contain only ultraviolet fluorescing pigment. As discussed with FIG. 1, the ultraviolet eyespots and the visible eyespots can overlap, partially overlap, or be non-overlapping.

Figure 3:
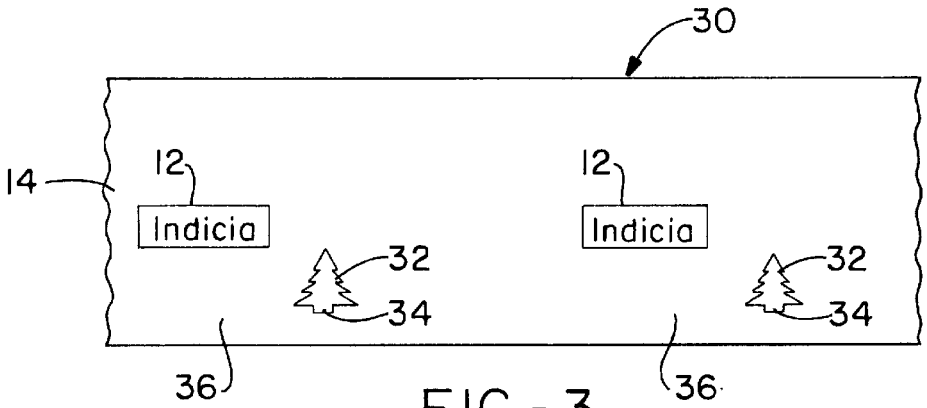
FIG. 3 is a view as in FIG. 1 showing a non-eyespot registration region containing an ultraviolet fluorescing compound for registration purposes.

FIG. 3 shows a portion of a label web (30) which does not contain a traditional visible eyestrip or eyespot, but rather contains an ultraviolet fluorescing pigment within one of the print dies. Each label (36) on the web (30) contains print indicia (12) and decorative designs (32), a portion of which functions to serve as an ultraviolet registration mark (34). The incorporation of an ultraviolet fluorescing pigment into one of the existing printing inks in the design permits one of the printing stations on the printing deck to function both as coloration and eyespot or as a region locator. Once again, as mentioned previously, the ultraviolet fluorescing pigment can be either a non-visible ultraviolet pigment or a visible naturally ultraviolet fluorescing pigment.

Figure 4:
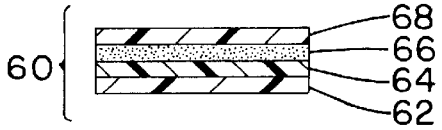
FIG. 4 is a cross-sectional view of a web of labels.

FIG. 4 shows a cross-sectional view of a web label (60). Typical designs typically include a bottom layer (62) and print indicia (64), which is adhesively secured (66) to top layer (68). The top and bottom layers are typically oriented polypropylene layers which are bonded together with an adhesive as is well-known in the art of label manufacturing.

Figure 5:
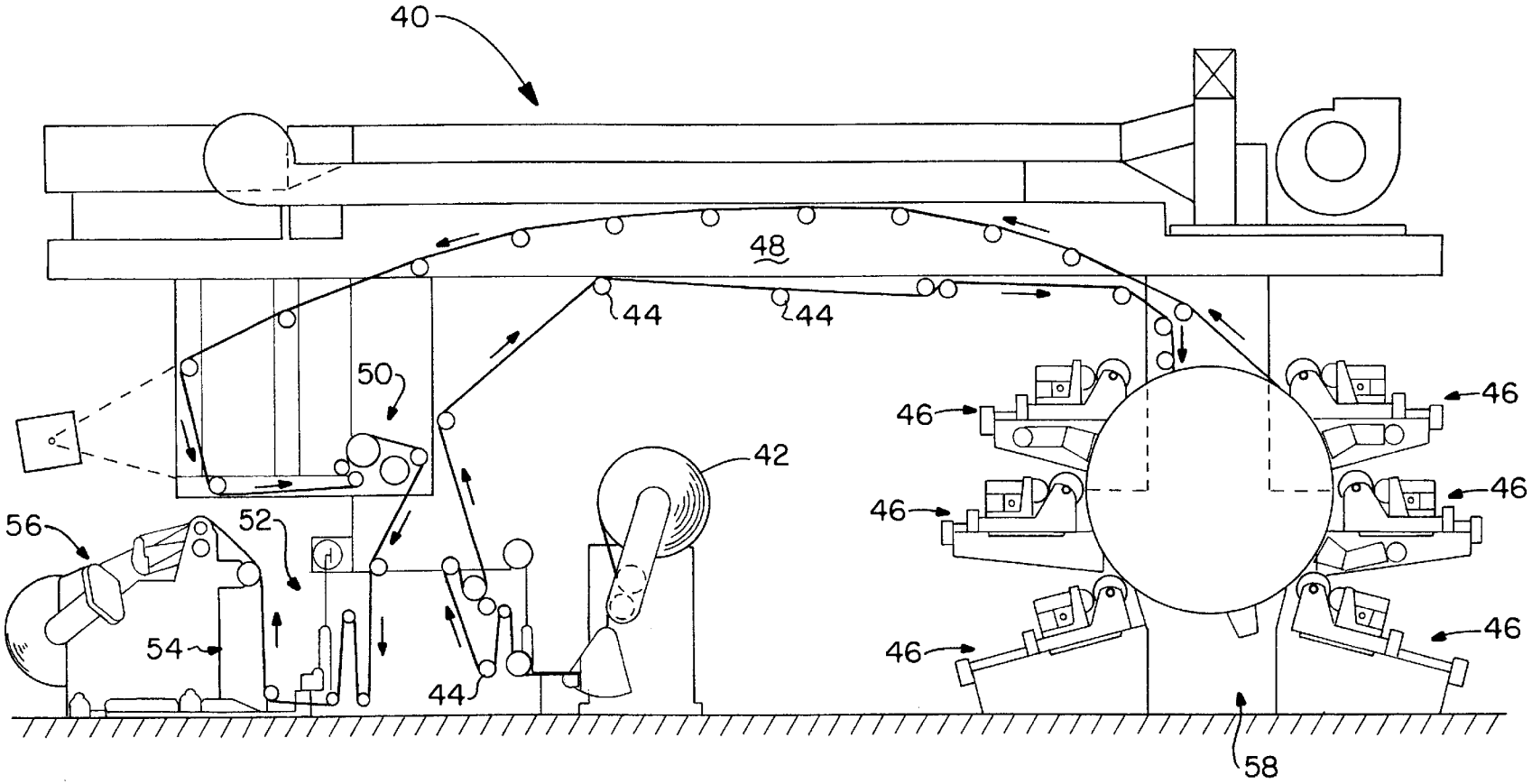
FIG. 5 is a schematic showing a label manufacturing process complete with printing decks.

FIG. 5 shows a process schematic (40) for the manufacture of a web of labels. A web is unwound from unwind station (42) and passed through a series of nip rolls (44) to adjust the tension of the web leading to printing station (58) containing a plurality of individual printing stations (46). The web is passed through each printing station and fed into dryer (48) to dry the ink, followed by passage over chill rolls (50), powder spray unit (52), slitting station (54) for ultimate rewinding at rewind station (56).

The ink used for marking comprises a vehicle which dries clear and pigments which are normally invisible, but which cause a shift in the wavelength of the electromagnetic spectrum in a limited, well-defined, wavelength band. Typically, a web is stored in a roll on a mandrel until it is to be unwound for processing. When stored on a roll, it is necessary that the marking indicia not bleed through or migrate among different layers of plastic thereby disrupting the well-defined pattern of markings.

As used in this application, the term "naturally fluorescing visible pigment" is meant to include all non-polar or non-ionic pigments which impart both fluorescence, as measured by fluorescing strength, and color to another substance, a non-limiting listing of which would include the exemplary chemical moieties.

| | Chemical Formula |
|---|---|
| Diarylide Yellow Structures | |
| Pigment Yellow 12 (C.I. No. 21090) | 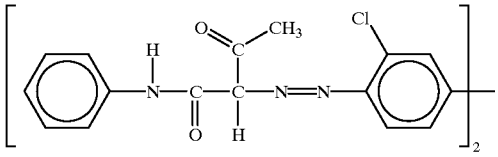 |
| Pigment Yellow 13 (C.I. No. 21100) | 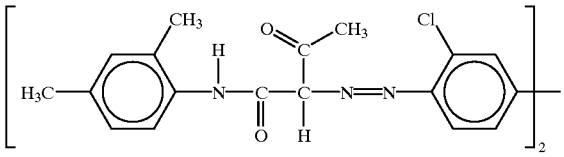 |
| Pigment Yellow 14 (C.I. No. 21095) | 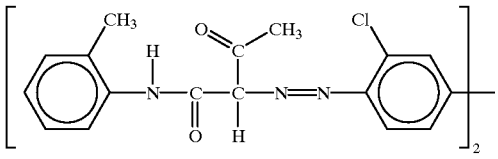 |
| Pigment Yellow 17 (C.I. No. 21105) | 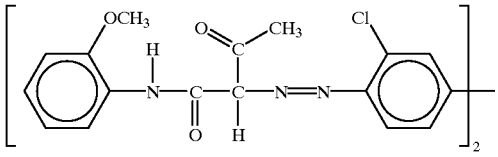 |
| Pigment Yellow 83 (C.I. No. 21108) | 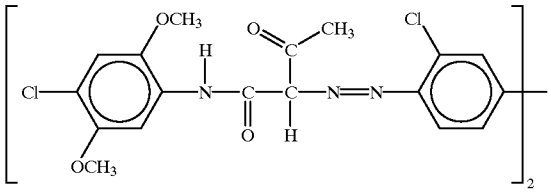 |
| Pyrazolone or Benzidine Orange Structures | |
| Pigment Orange 13 (C.I. No. 21110) | 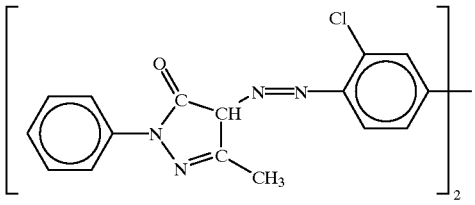 |
| Pigment Orange 34 (C.I. No. 21115) | 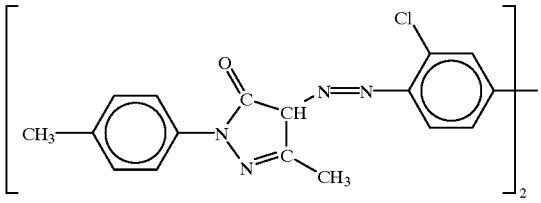 |

It should be recognized that the above structures potentially exist in both keto and enol forms due to the existence of keto-enol tautomerism, which favors the keto form of the compound (shown above) over the enol form of the compound. In its simplest form, this type of tautomerism exists between functional groups within a molecule such as shown below.

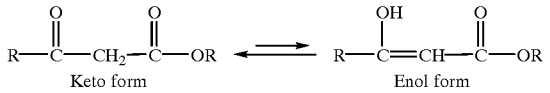

Therefore, an exemplary non-limiting list of pigments for use in this application would include Yellow 12, Yellow 13, Yellow 14, Yellow 17, Yellow 83, Yellow 109, Yellow 114, Yellow 126, Yellow 127, Yellow 139, Yellow 176, Yellow 185, Orange 5, Orange 13, Orange 16, Orange 34, Orange 46, Red 22, Red 23, Red 37, Red 38, Red 41, Red 42, Red 48:1, Red 48:2, Red 49:2, Red 53 and Violet 3.

In a preferred embodiment of the invention, the fluorescing ultraviolet pigment will be selected from the group consisting of diarylide and pyrazolone pigments as taught for example in U.S. Pat. No. 4,648,907, U.S. Pat. No. 4,946,508, U.S. Pat. No. 4,946,509, U.S. Pat. No. 5,021,090 and U.S. Pat. No. 5,062,894, the teachings of which are hereinby fully incorporated by reference. When the pigment is a pyrazolone pigment, it preferably will contain both a —N=N— group; and a

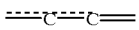

group showing π-bond delocalization, which form a chromophore within the pigment.

In a more preferred embodiment, the pigment will contain at least the following chemical disazo pyrazolone structure wherein the substituents X, Y and Z are as follows for the identified pigments

| Pigment | X | Y | Z |
|---|---|---|---|
| Orange 13 | Cl | $CH_3$ | H |
| Orange 34 | Cl | $CH_3$ | $CH_3$ |
| Red 37 | $OCH_3$ | $CH_3$ | $CH_3$ |
| Red 38 | Cl | $COOC_2H_5$ | H |
| Red 41 | $OCH_3$ | $CH_3$ | H |
| Red 42 | $OCH_3$ | $COOC_2H_5$ | H |

and wherein in general, X, Y and Z are selected as follows:

X is selected from the group consisting of Cl, $C_{1-4}$ alkyl, and $C_{1-4}$ alkoxy;

Y is selected from the group consisting of $C_{1-4}$ alkyl, and COOR wherein R is a $C_{1-4}$ alkyl; and Z is selected from the group consisting of H and $C_{1-4}$ alkyl.

In yet another embodiment of this invention, the pigment will contain at least the following chemical azomethine structure selected from the following two formulas:

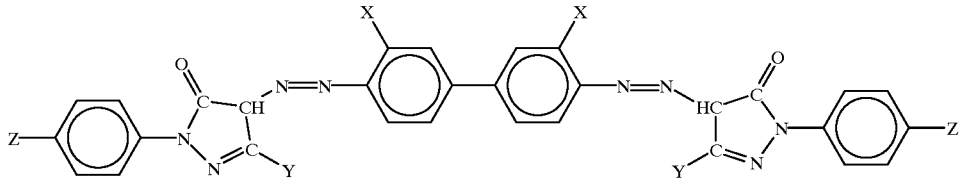

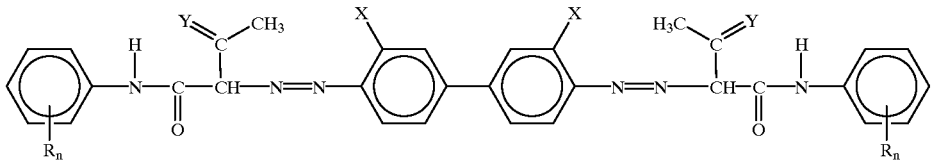

and

-continued

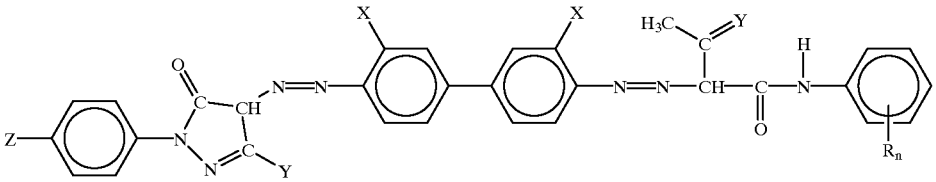

wherein the substituents X, Y and Z are as follows

X is selected from the group consisting of Cl, $C_{1-4}$ alkyl, and $C_{1-4}$ alkoxy;

Y is independently selected from the group consisting of N—$R^1$ wherein $R^1$ is selected from the group consisting of alkylene oxide polymers containing about 4 to about 200 groups, N—$R^2$ wherein N—$R^2$ is derived from a water-soluble primary amine and $R^2$ is a monomeric or polymeric hydrocarbyl group containing 1–20 carbons and O;

Z is selected from the group consisting of H, Cl and $C_{1-4}$ alkyl;

R is independently selected from the group consisting of H, Cl, $C_{1-4}$ alkyl, and $C_{1-4}$ alkoxy; and n is an integer value from 1 to 5 inclusive.

The water-soluble amine must be a primary amine and pererably contains one or more hydrophilic functionalities, e.g., OH, $OR^3$, $N(R^3)_2$, $NH_2$, $NO_2$, $SO_3H$, COOH and $PO_3H$, wherein $R^3$ is a $C_{1-4}$ alkyl. Specific non-limiting examples of the primary amine would include $H_2N—CH_2—CH_2—OH$, $H_2N—CH_2—CH_2—CH_2—N(CH_3)_2$, $H_2N—CH_2—CH_2—CH_2—N(CH_2CH_2—OH)_2$, $H_2N—CH_2—CH_2—CH_2—NH—CH_2—CH_2—NH—CH_2—CH_2—CH_2—NH_2$, $H_2N—CH_2—CH_2—NH_2$, $H_2N—CH_2—CH_2—O—CH_2—CH_2—OH$, $H_2N—(CH_2—CH_2—NH)_n—CH_2—CH_2—NH_2$ wherein n is from 2 to 100 inclusive,

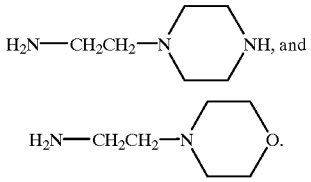

In a more preferred embodiment, the alkylene oxide polymer is an ethylene oxide polymer. In yet another embodiment, the alkylene oxide polymer is an ethylene oxide/propylene oxide copolymer.

In yet another embodiment of the invention, the diarylide pigment will contain the following chemical azomethine structure wherein R is selected independently from the group consisting of $C_{1-4}$ alkyl, $C_{1-4}$ alkoxy, and halogen;

n and m are integers ranging independently from 0 to 5 inclusive;

X is selected from the group consisting of Cl, $C_{1-4}$ alkyl and $C_{1-4}$ alkoxy;

B is a divalent bridging moiety selected from the group consisting of $C_{1-6}$ alkyl; $NHSO_2$, O, CO, COO, and CONH;

V comprises a poly(alkylene oxide) having a number average molecular weight of about 200 to 10,000; and j and k are independently integers of 0 or 1, with the proviso that for at least 50 weight percent of the pigment, j and k are both equal to 0, and for at least 3 weight percent of the pigment, j and k are equal to 1.

In a more preferred embodiment, the alkylene oxide polymer is an ethylene oxide polymer having a number average molecular weight of 1,000 to 3,000. In yet another embodiment, the alkylene oxide polymer is an ethylene oxide/propylene oxide copolymer.

It is particularly preferred that the poly(alkylene oxide) comprises an ethylene oxide/propylene oxide copolymer, especially a copolymer that is encompassed by the general formula shown below.

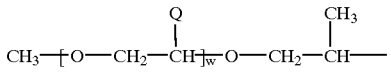

wherein Q is H or $CH_3$ and w is an integer from 4 to 200 inclusive, preferably 20 to 65.

A preferred diarylide pigment composition is one in which 50–97 weight percent, preferably 70–90 weight percent of the composition is a composition of formula (I) with a balance comprising a compound of the general formula (II) and/or a compound of the general formula (III). Formula (I) would comprise:

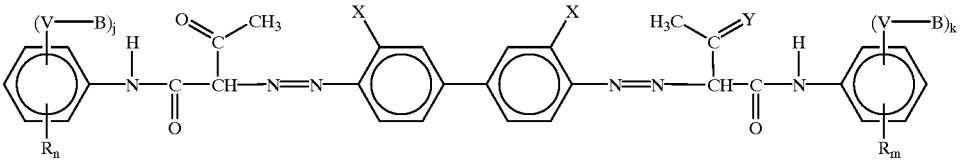

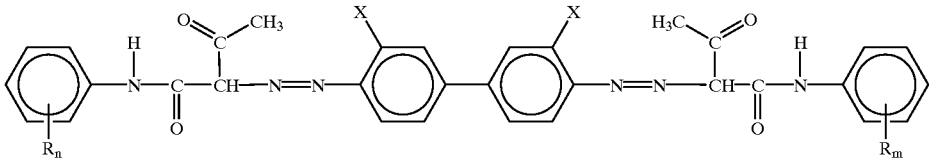

while formula (II) would comprise:

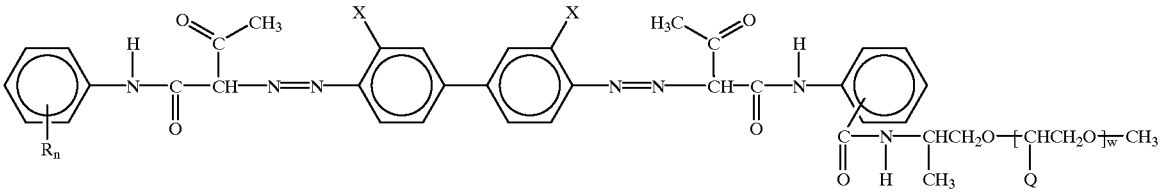

and wherein formula (III) would comprise:

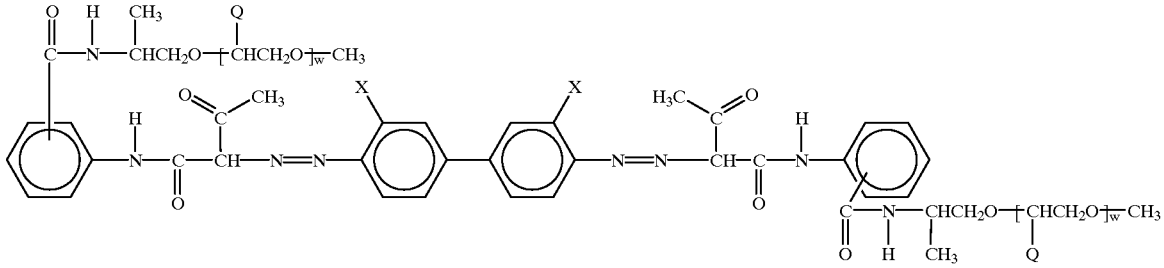

and wherein the definitions of the Markush groups remain consistent with those previously defined in context.

When the pigment is a diarylide pigment, it will contain at least one group which is capable of undergoing enol-keto tautomerism.

Therefore, contrary to the teachings of the Prior Art, this invention utilizes fluorescing pigments, not dyes to achieve the result. As seen in the previous chemical formulas shown for the orange and yellow pigments, these pigments are non-polar and non-ionic. With pigments, insolubility is a key property. When applied in a vehicle to a substrate, they either remain on the surface or have a tendency to fill the voids in paper or other irregular surfaces. Insoluble pigments differ from dyes, which can be dispersed in a monomolecular form and are often regarded as being dissolved in a system.

The best mode for carrying out the invention will now be described for the purposes of illustrating the best mode known to the applicant at the time. The examples are illustrative only and not meant to limit the invention, as measured by the scope and spirit of the claims. A specific example involving printed lamination of two materials for a label intended to be applied to a 20 ounce polyester (PET) bottle will now be described.

EXAMPLE

A ply of 41" wide, 1.1 mil cavitated oriented white polypropylene film (Applied Extrusion Technology grade 400 WT/L2), is unwound and printed on a six color Paper Converting Machinery Central Impression Flexographic Printing Press. Four visible colors are printed in decks 1 through 4 in the sequence of tan, yellow, orange and dark brown using solvent-based polyamide inks. Printing cylinders with 18.85" circumference are used to print a two around design, resulting in a 9.425" design cutoff A visible eyemark measuring ⅝" by 7/32" is printed at the bottom left corner of the label design using the dark brown ink. In this case, the registration is potentially hampered by the presence of other print copy in the lane stretching between the eyemarks. This other print copy information consists of a list of liquid ingredients and container weight information. A 5th printing station contains an ultraviolet fluorescing pigment e.g., Yellow 12 to print a second eyespot which is not apparent in the visible spectrum, but is apparent when subjected to ultraviolet light. This solvent-based varnish is printed using a similarly sized ⅝" by 7/32" eyespot and is applied with a ceramic 360 lin/inch 3.7 cubic billion micron volume anilox roller in combination with a fountain roller. Solution viscosity is maintained at 25 seconds with a #2 Zahn cup. Coating application density is 2.18 lbs. per 3,000 sq. ft. Web speed is 450 feet per minute.

After each of the five printing stations, a short forced air dryer section is used to set (surface dry) the ink. The last station of the printing press is used to apply an overall coating of a water-based acrylic adhesive at a rate of 1.25 lbs per 3,000 sq.ft. The printed adhesive-laden web is carried through a forced air oven controlled to a temperature of 125° F., nipped at a heated roller to combine it to another ply of 41¼", 0.45 mil oriented clear polypropylene film (Applied Extrusion Technology grade 45 B503). The laminated label web is carried to a rewinder to form a large master roll.

A second converting operation finished the process by slitting the large master roll into individual lanes of film, 4" wide by 15,708 ft, to match the size specified in the customer order. The labels are transported in the above roll form to a manufacturing location that applies the labels to the container using an ultraviolet scanner eye (Sick LUT-4), to sense the registration mark on the label which registers the positioning of the other graphic design elements to the container. The containers are applied at a rate of 500 bottles per minute).

The invention has been described with reference to preferred and alternate embodiments. Obviously, modifications and alterations will occur to others upon the reading and understanding of the specification. It is intended to include all such modifications and alterations insofar as they come within the scope of the appended claims or the equivalents thereof.

What is claimed is:

1. A label web having a plurality of discrete labels thereupon comprising:

a pair of plies in face-to-face relationship with one another;

a visible coating on at least one surface of at least one of the plies, the coating being in the form of a repetitive pattern to provide a series of separable web sections;

each of the sections being adapted for separation from the web to provide a commodity of substantially identical commodities formed by separation from the web;

at least one visible eyemark on the web between the plies; and at least one non-migratory ultraviolet fluorescing eyemark on the web between the plies, the at least one ultraviolet fluorescing eyemark being a fluorescing ultraviolet pigment; wherein the fluorescing ultraviolet pigment is non-polar or non-ionic.

2. The web of claim 1 wherein the eyemarks at least partially overlap.

3. The web of claim 1 wherein the eyemarks completely overlap.

4. The web of claim 1 wherein the fluorescing ultraviolet pigment is selected from the group consisting of diarylide and pyrazolone pigments.

5. The web of claim 4 wherein the pigment is a pyrazolone pigment and contains both a —N═N— group; and a group which form a chromophore within the pigment.

6. The web of claim 4 wherein the pigment is a diarylide pigment and contains at least one group capable of undergoing enol-keto tautomerism.

7. The web of claim 4 wherein the pyrazolone comprises:

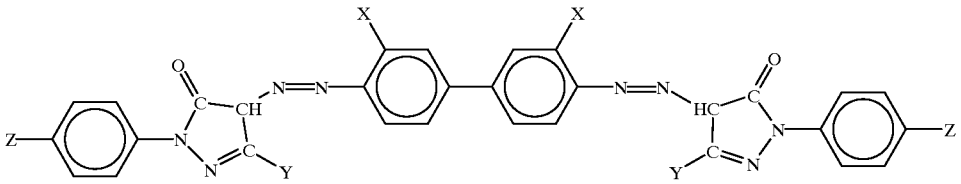

wherein

X is selected from the group consisting of Cl, $C_{1-4}$ alkyl, and $C_{1-4}$ alkoxy;

Y is selected from the group consisting of $C_{1-4}$ alkyl, and COOR wherein R is a $C_{1-4}$ alkyl; and Z is selected from the group consisting of H and $C_{1-4}$ alkyl.

8. The web of claim 1 wherein the fluorescing ultraviolet pigment is selected from one of the two formulas which comprise:

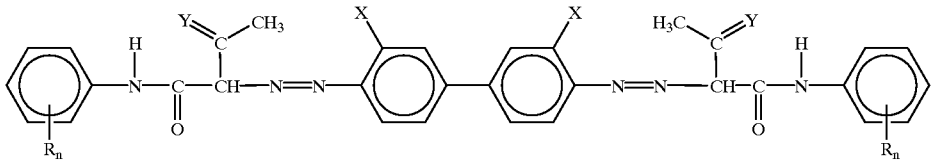

and

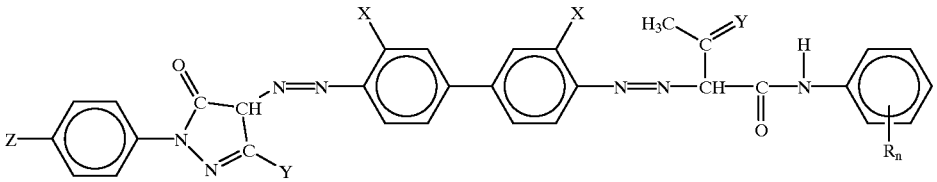

wherein

X is selected from the group consisting of Cl, $C_{1-4}$ alkyl, and $C_{1-4}$ alkoxy;

Y is independently selected from the group consisting of N—$R^1$ wherein $R^1$ is selected from the group consisting of alkylene oxide polymers containing about 4 to about 200 groups, N—$R^2$ wherein N—$R^2$ is derived from a water-soluble primary amine and $R^2$ is a monomeric or polymeric hydrocarbyl group containing 1–20 carbons and O;

Z is selected from the group consisting of H, Cl and $C_{1-4}$ alkyl;

R is independently selected from the group consisting of H, Cl, $C_{1-4}$ alkyl, and $C_{1-4}$ alkoxy; and n is an integer value from 1 to 5 inclusive.

9. The web of claim 8 wherein the alkylene oxide polymer is an ethylene oxide polymer.

10. The web of claim 8 wherein the alkylene oxide polymer is an ethylene oxide/propylene oxide copolymer.

11. The web of claim 4 wherein the diarylide pigment comprises an azomethine structure

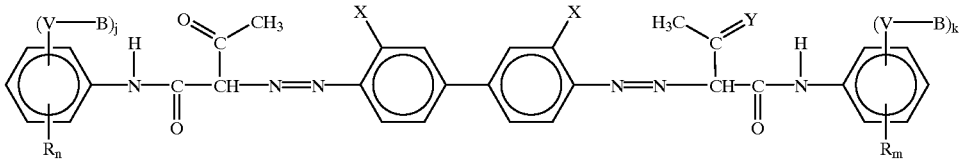

wherein

R is selected independently from the group consisting of $C_{1-4}$ alkyl, $C_{1-4}$ alkoxy, and halogen;

n and m are integers ranging independently from 0 to 5 inclusive;

X is selected from the group consisting of Cl, $C_{1-4}$ alkyl and $C_{1-4}$ alkoxy;

B is a divalent bridging moiety selected from the group consisting of $C_{1-6}$ alkyl; $NHSO_2$, O, CO, COO, and CONH;

V comprises a poly(alkylene oxide) having a number average molecular weight of about 200 to 10,000; and j and k are independently integers of 0 or 1, with the proviso that for at least 50 weight percent of the pigment, j and k are both equal to 0, and for at least 3 weight percent of the pigment, j and k are equal to 1.

12. The web of claim 11 wherein the poly(alkylene oxide) is an ethylene oxide polymer having a number average molecular weight of 1,000 to 3,000.

13. The web of claim 11 wherein the poly(alkylene oxide) is an ethylene oxide/propylene oxide copolymer.

14. The web of claim 12 wherein the poly(alkylene oxide) comprises an ethylene oxide/propylene oxide copolymer

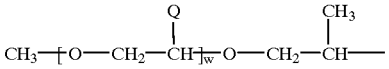

wherein

Q is selected from the group consisting of H or $CH_3$; and w is an integer from 4 to 200 inclusive.

15. The web of claim 4 wherein the diarylide pigment comprises 50–97 weight percent of the composition of formula (I) with a balance comprising a compound of the general formula (II) and/or a compound of the general formula (III) and wherein formula (I) comprises

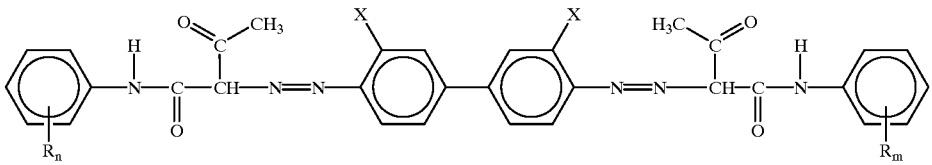

and wherein formula (II) comprises

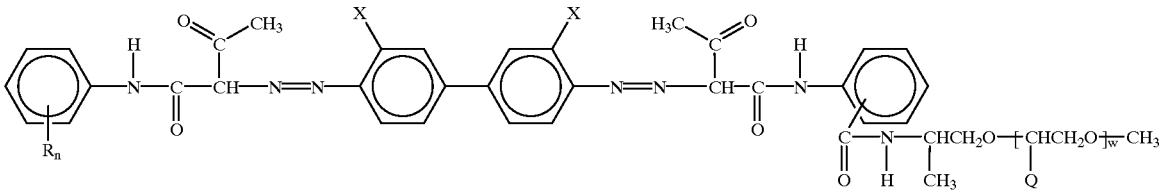

and wherein formula (III) comprises

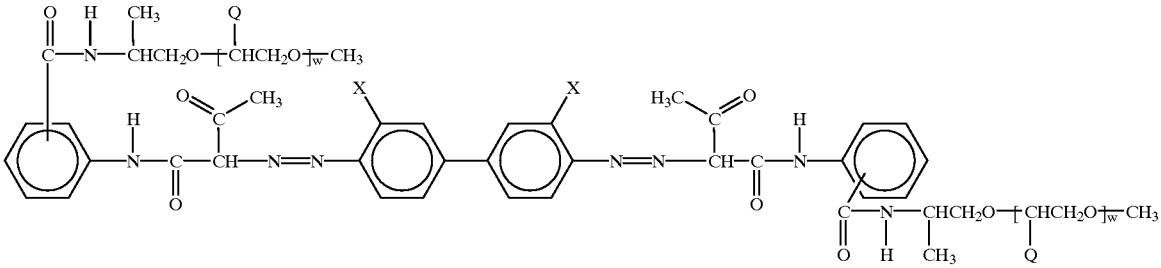

and further wherein

X is selected from the group consisting of Cl, $C_{1-4}$ alkyl and $C_{1-4}$ alkoxy;

Q is selected from the group consisting of H and $CH_3$; and w is an integer from about 4 to 200 inclusive;

R is selected independently from the group consisting of $C_{1-4}$ alkyl, $C_{1-4}$ alkoxy, and halogen; and n and m are integers ranging independently from 0 to 5 inclusive.

16. The web of claim 4 wherein the fluorescing ultraviolet pigment is selected from the group consisting of Yellow 12, Yellow 13, Yellow 14, Yellow 17, Yellow 83, Yellow 109, Yellow 114, Yellow 126, Yellow 127, Yellow 139, Yellow 176, Yellow 185, Orange 5, Orange 13, Orange 16, Orange 34, Orange 46, Red 22, Red 23, Red 37, Red 38, Red 41, Red 42, Red 48:1, Red 48:2, Red 49:2, Red 53 and Violet 3.

17. The web of claim 1 wherein the visible and ultraviolet fluorescing eyemark are printed onto the web with one deck of a printing station.

18. The web of claim 1 wherein the ultraviolet fluorescing eyemark is discrete from the visible eyemark and is positioned in a non-edge region of an individual label of the web.

19. A label web having a plurality of discrete labels printed thereupon comprising:

a web of material;

a visible coating on at least one surface of said web, the coating being in the form of a repetitive pattern to provide a series of separable web sections;

each of the sections being adapted for separation from the web to provide a commodity of substantially identical commodities formed by separation from the web; and at least one non-migratory ultraviolet fluorescing eyemark on said web, the at least one ultraviolet fluorescing eyemark being a fluorescing ultraviolet pigment, wherein the fluorescing ultraviolet pigment is non-polar or non-ionic.

* * * * *